US007360731B2

(12) United States Patent
Easton et al.

(10) Patent No.: US 7,360,731 B2
(45) Date of Patent: Apr. 22, 2008

(54) SHREDDER

(75) Inventors: Michael John Easton, Hampshire (GB); Michael David Sawford, Buckinghamshire (GB)

(73) Assignee: ACCO UK Limited, Aylesbury (GB)

( * ) Notice: Subject to any disclaimer, the term of this patent is extended or adjusted under 35 U.S.C. 154(b) by 78 days.

(21) Appl. No.: 11/426,060

(22) Filed: Jun. 23, 2006

(65) Prior Publication Data

US 2007/0145170 A1 Jun. 28, 2007

(30) Foreign Application Priority Data

Jul. 1, 2005 (GB) ..... 0513480.4

(51) Int. Cl.
*B02C 18/16* (2006.01)

(52) U.S. Cl. ..... 241/100; 241/101.2; 241/236; 241/285.3

(58) Field of Classification Search ..... 241/100, 241/236, 285.3, 101.2
See application file for complete search history.

(56) References Cited

U.S. PATENT DOCUMENTS

| | | | | |
|---|---|---|---|---|
| 929,960 | A | 8/1909 | Low | |
| 3,754,498 | A | 8/1973 | Gil | |
| 3,861,117 | A | 1/1975 | DeFilippi | |
| 4,754,933 | A | 7/1988 | Leuthold et al. | |
| 4,991,500 | A | 2/1991 | Knapp et al. | |
| 5,044,270 | A | 9/1991 | Schwelling | |
| 5,155,975 | A | 10/1992 | Knowler | |
| 7,114,314 | B2 | 10/2006 | Stravitz | |
| 7,150,422 | B2 * | 12/2006 | Wang | 241/100 |

(Continued)

FOREIGN PATENT DOCUMENTS

| | | |
|---|---|---|
| DE | 2214800 | 9/1973 |

(Continued)

OTHER PUBLICATIONS

European Search Report and Search Opinion for corresponding European Application No. 06012628.1 mailed on Oct. 6, 2006.

(Continued)

*Primary Examiner*—Mark Rosenbaum
(74) *Attorney, Agent, or Firm*—Michael Best & Friedrich LLP

(57) ABSTRACT

The improvements relate to shredders for paper and the like having a shredding mechanism with an opening through which shredded material passes out of the shredding mechanism, a compactor plate located beneath the shredding mechanism and including an opening, and a base, wherein the shredder has a waste bag support mechanism of which the compactor plate forms a part. The waste bag support mechanism is secured to the underside of the shredding mechanism towards the rear thereof for pivotal movement between an operating position in which an upper part of the waste bag support mechanism is close to the underside of the shredding mechanism, and a bag removal position in which the upper part of the waste bag support mechanism is pivoted downwards at its front away from the shredding mechanism. The waste bag support mechanism includes extending runners on which the compactor plate is mounted for sliding movement between the operating position located beneath the shredding mechanism in which the opening in the compactor plate is substantially directly beneath the opening through which the shredded material passes, and the bag removal position in which the compactor plate is located forward of the shredding mechanism.

6 Claims, 4 Drawing Sheets

U.S. PATENT DOCUMENTS

| | | | |
|---|---|---|---|
| 2005/0126130 | A1 | 6/2005 | Stravitz |
| 2006/0151647 | A1 | 7/2006 | Easton et al. |

FOREIGN PATENT DOCUMENTS

| | | |
|---|---|---|
| DE | 3922313 | 1/1991 |
| DE | 4201380 | 7/1993 |
| DE | 4408231 | 9/1995 |
| DE | 29622139 | 3/1997 |
| DE | 19539792 | 4/1997 |
| EP | 1669187 | 6/2006 |
| GB | 2306348 | 5/1997 |
| JP | 2194851 | 8/1990 |
| JP | 11276260 | 10/1999 |
| JP | 2001-293390 | 10/2001 |
| JP | 2001-300339 | 10/2001 |
| WO | WO 99/33644 | 7/1999 |

OTHER PUBLICATIONS

UK Search Report dated Oct. 6, 2005 for corresponding Application No. GB0513480.4.

* cited by examiner

SHREDDER

BACKGROUND OF THE INVENTION

The invention relates to improvements in shredders, in particular to the manner in which the shredded material is handled in shredders of the kind intended for the shredding of paper and the like, and generally used in offices.

Shredders have been known for many years, and are used to shred documents such that they are safely disposed of and cannot be readily reconstructed. Originally shredders simply cut the paper into long strips, but more recently they have in general also cross cut those strips into short lengths. This has two main advantages, the first is that reconstruction of the documents is made much more difficult, and secondly the waste is less bulky as the long strips tended to act like springs, and do not naturally compact, whereas shorter pieces do not suffer from this problem to the same extent.

One problem with shredders is how often the waste container needs to be emptied. The shredding mechanism of most shredders will cut off when the waste in the container builds up underneath the shredding mechanism. In most shredders without any form of compaction mechanism, particularly those which do not cross-cut, this happens often and the user then has to open the container and push the waste material down to compress it before they can continue their shredding. In some shredders, particularly those which do not cross-cut, the waste may be crinkled as it leaves the shredding mechanism to reduce its springiness, and in these cases the problem should occur less often. However, it is clearly desirable to be able to operate a shredder for as long as possible without having to either compact the waste by hand, or empty the waste container.

It is an object of the present invention to address the above described problem.

SUMMARY OF THE INVENTION

According to the present invention there is provided a shredder for paper and the like having a shredding mechanism with an opening through which shredded material passes out of the shredding mechanism, a compactor plate located beneath the shredding mechanism and including an opening, and a base, wherein the shredder has a waste bag support mechanism of which the compactor plate forms a part.

Preferably the waste bag support mechanism is secured to the underside of the shredding mechanism towards the rear thereof for pivotal movement between an operating position in which an upper part of the waste bag support mechanism is close to the underside of the shredding mechanism, and a bag removal position in which the upper part of the waste bag support mechanism is pivoted downwards at its front away from the shredding mechanism.

Preferably the waste bag support mechanism includes extending runners on which the compactor plate is mounted for sliding movement between the operating position located beneath the shredding mechanism in which the opening in the compactor plate is substantially directly beneath the opening through which the shredded material passes, and the bag removal position in which the compactor plate is located forward of the shredding mechanism.

Conveniently the waste bag support mechanism further includes a waste bag support plate movable between the operating position in which it is located beneath the shredding mechanism above the base of the shredder with a space between the platform and the base of the shredder, and the bag removal position in which it is closer to the base of the shredder.

The waste bag support mechanism may include means to retain a waste bag for collection of the shredded material after it has passed through the opening in the compactor plate.

Preferably the compactor plate includes a guide to the opening which, when the waste bag support mechanism is in the operating position is located close to the opening in the shredding mechanism through which the shredded material passes out of the shredding mechanism.

The means to retain a waste bag for collection of the shredded material is conveniently provided by the proximity of the guide in the compactor plate to the underside of the shredding mechanism.

BRIEF DESCRIPTION OF THE DRAWINGS

An example of a shredder according to the invention will now be described, by way of example only, with reference to the accompanying drawings in which.

DETAILED DESCRIPTION

Figure 1:
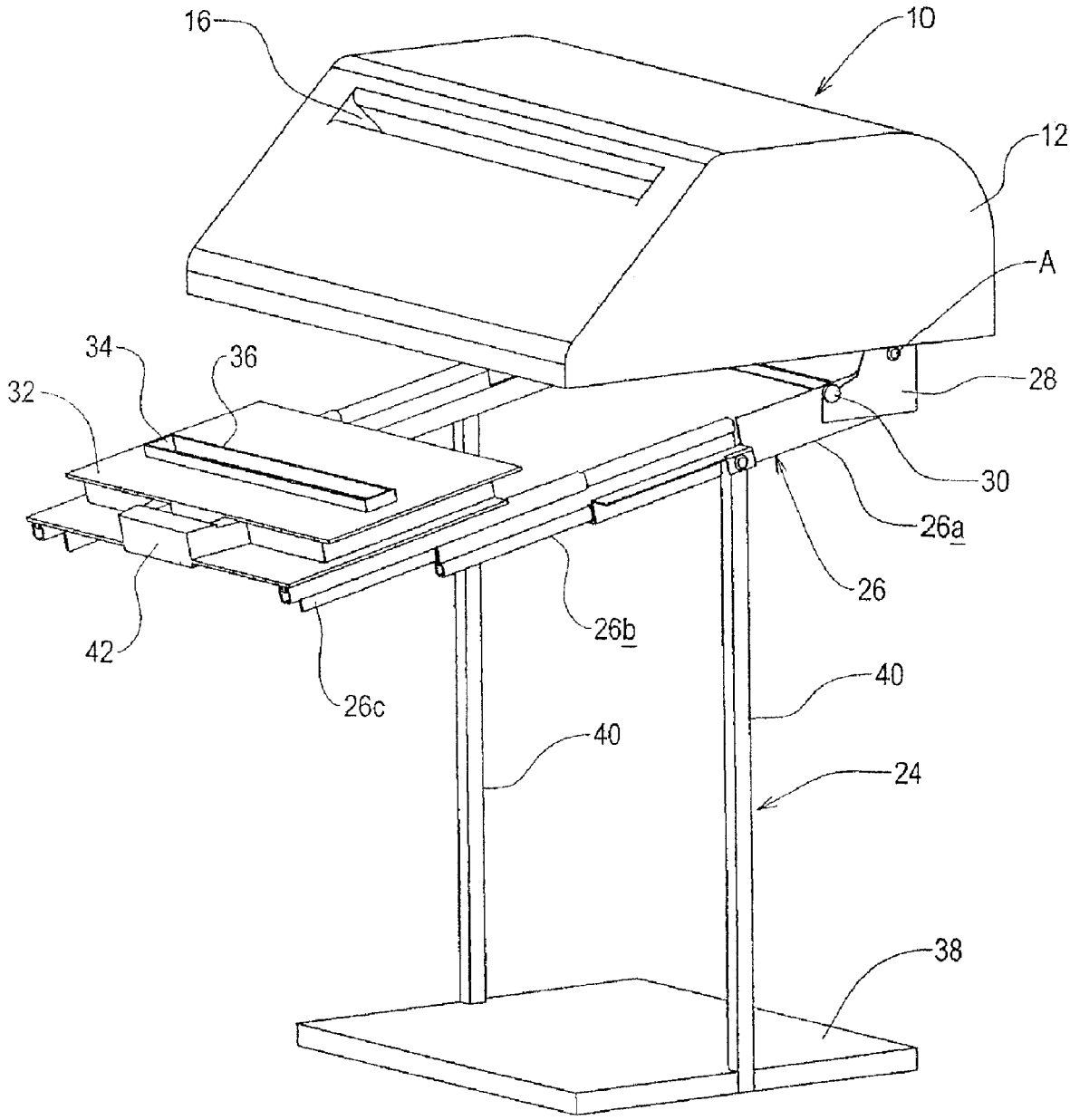
FIG. 1 is a perspective view of the shredder according to the invention from above and one side, with the cabinet removed to reveal a waste bag support mechanism of the invention, in its bag removal position.

Referring to the Figures, a shredder 10 according to the invention will now be described. In conventional manner the shredder 10 includes a shredding mechanism 12, supported on a cabinet 14.

The shredding mechanism 12 has an opening 16 for receipt of sheet material, such as paper and light card, to be shredded, leading to a chute 18 down which the material to be shredded passes before it reaches the cutting heads 20 which are powered by an electric motor and drive (not shown). The shredded material is pushed out of the shredding mechanism 12 through an opening in its underside (not shown) by the cutting heads 20. As the manner in which the shredding mechanism operates has no bearing on the present invention it will not be described further.

The cabinet 14 has a base 22, three sides and a door (not shown) at the front which can be opened to gain access to the interior of the cabinet 14.

Located within the cabinet 14 below the shredding mechanism 12 is a waste bag support mechanism 24. The waste bag support mechanism 24 comprises two sets of extending runners 26, one disposed to each side of the shredder 10, and secured to the underside of the shredding mechanism 12 by means of a bracket 28, such that they can pivot, as discussed below about axis A, the maximum angle of pivot being controlled by the existence of a peg 30 on each bracket 28. Each set of extending runners 26 in this example comprises first, second and third parts, referenced

26*a*, 26*b* and 26*c*, but shredders according to the invention may include different numbers of runners in the sets.

The waste bag support mechanism 24 also includes a compactor plate 32 which includes an opening 34 and a guide 36 in the form of a funnel on the top of the compactor plate 32. The compactor plate 32 is mounted on the sets of runners 26, and in particular on the third runner part 26*c*, for sliding and pivotal movement relative to the shredding mechanism 12 as will be discussed below.

The waste bag support mechanism 24 further includes a waste bag support platform 38 which is supported below the runners 26 by a pair of uprights 40, one on each side, which are pivotally connected to the first runner 26*a*, such that they can hang vertically downwards at all times, whatever the angle of the runners 26 with respect to the shredding mechanism 12.

Figure 2:
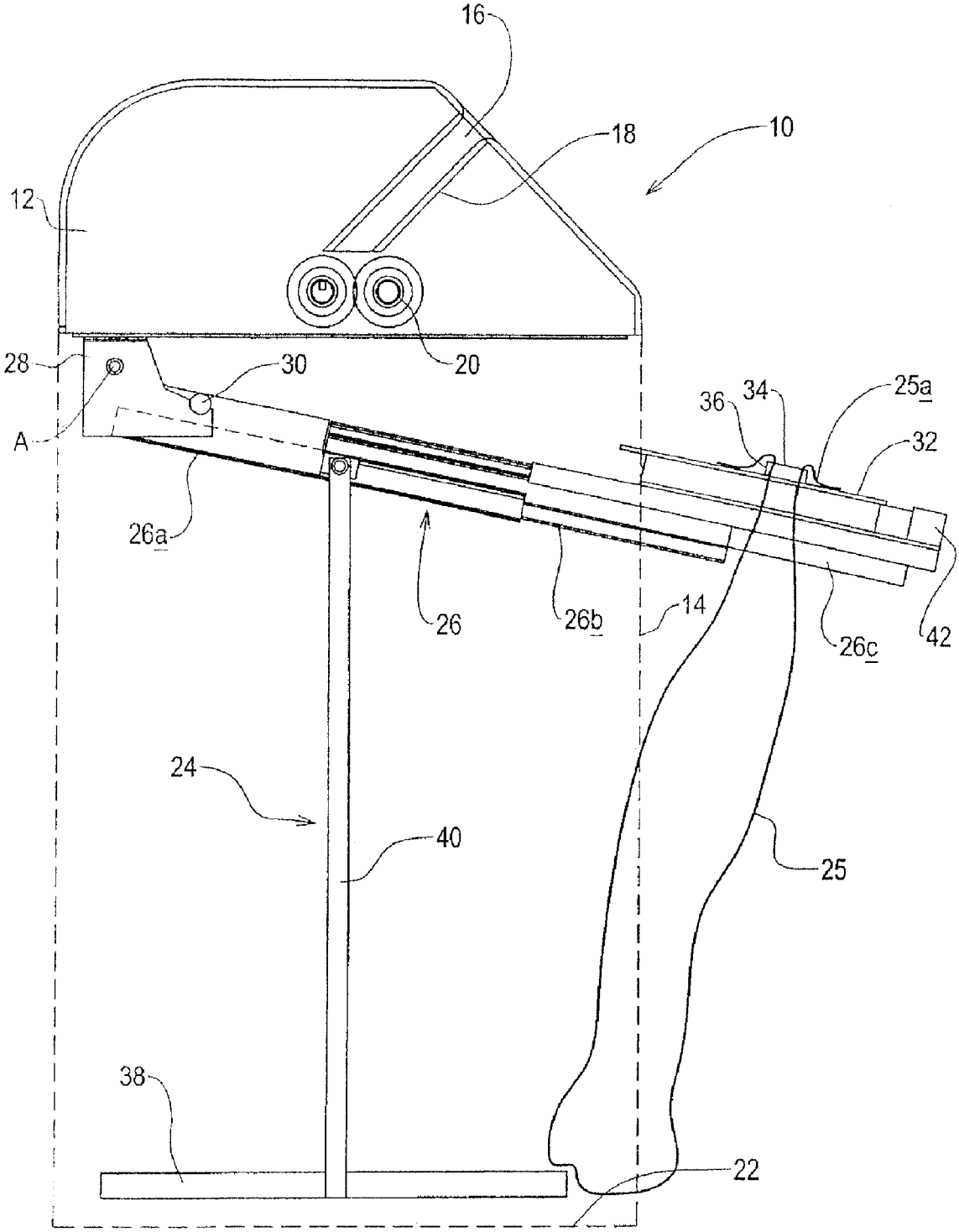
FIG. 2 is a side view of the shredder of FIG. 1, with the cabinet shown in chain lines, and the waste bag support mechanism of the invention, in its bag removal position.
Figure 3:
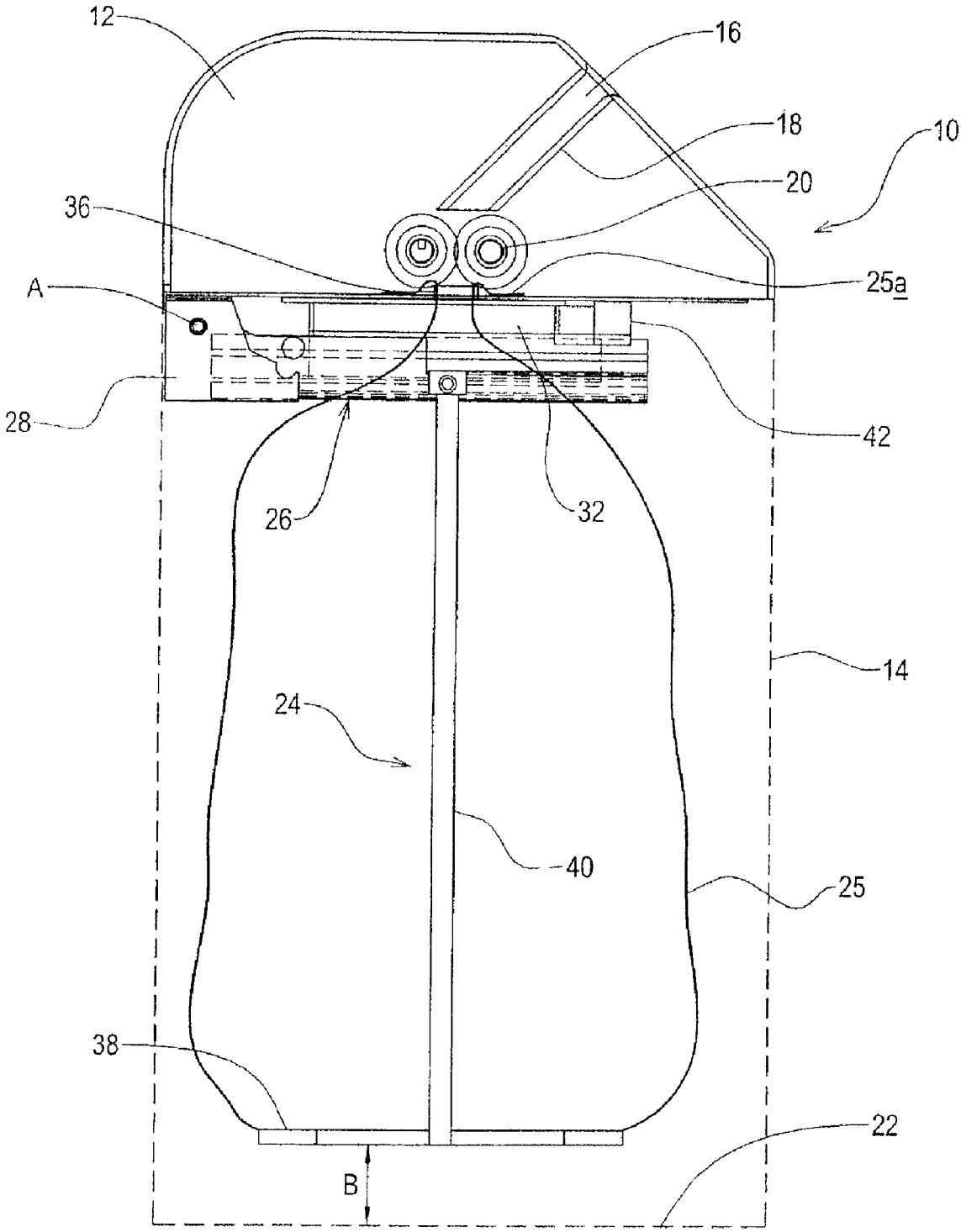
FIG. 3 is also a side view of the shredder of FIG. 1, with the cabinet shown in chain lines, and the waste bag support mechanism of the invention, in its operating position.
Figure 4:
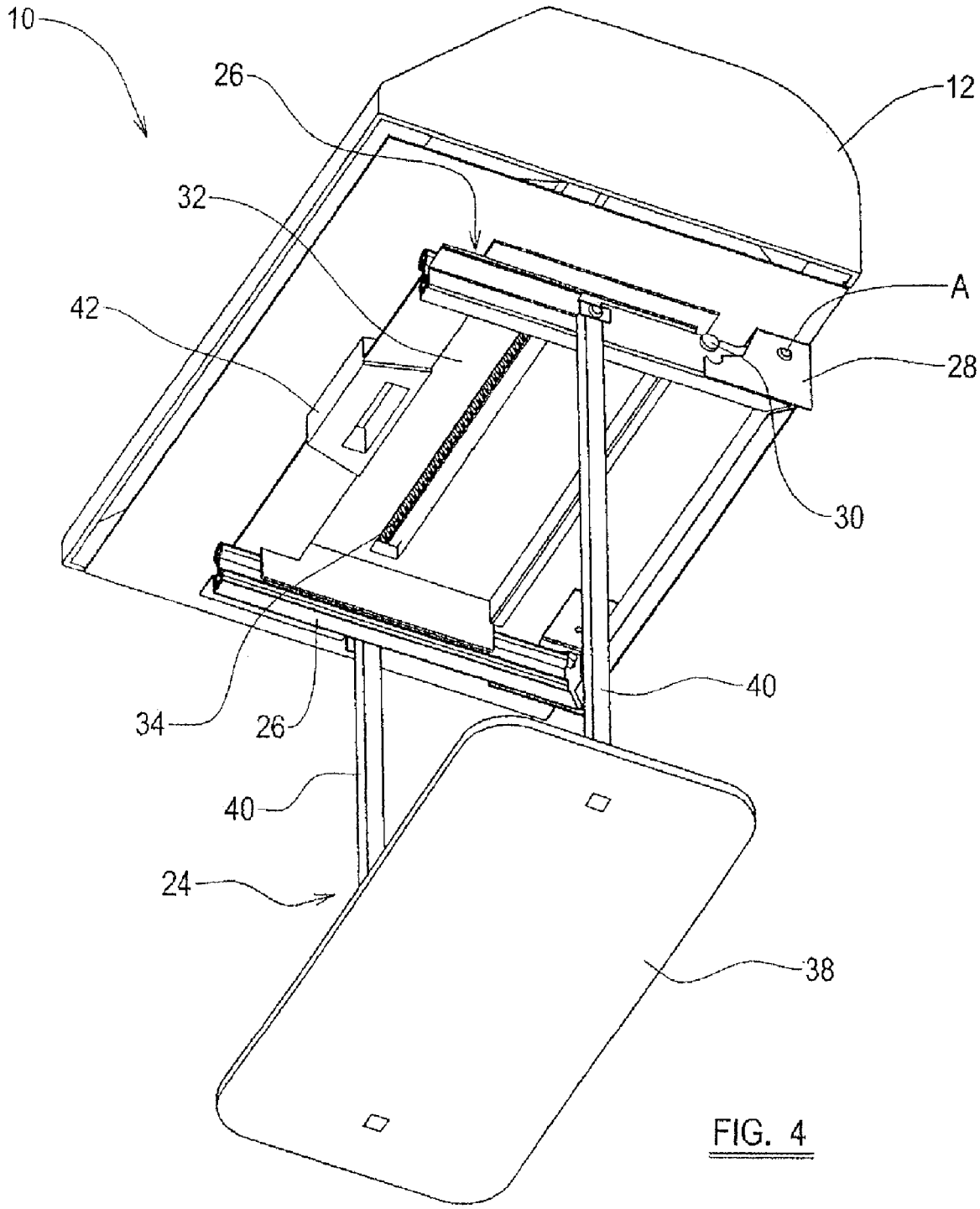
FIG. 4 is a perspective view of the shredder of FIG. 1, from beneath and one side, with the cabinet removed to reveal the waste bag support mechanism of the invention, in its operating position.

The waste bag support mechanism 24 has two positions, an operating position shown in FIG. 3 in which the runners 26 are in a retracted condition, and a bag removal position in which the runners 26 are in extended. In the operating position the compactor plate 32 is located beneath the shredder mechanism 12 such that the guide 36 and opening 34 are directly below the opening in the underside of the shredder mechanism 12 and all shredded material passes through the guide 36 and opening 34. In the bag removal position shown in FIG. 2 the runners 26 have been pivoted downwards and extended by operation of a handle 42 adjacent the compactor plate 32, such that the compactor plate 32 is located forwardly and downwardly of the shredding mechanism 12 and outside of the cabinet 14. When the waste bag support mechanism 24 is in its operating position the bag support plate 38 is located a distance B above the base 22 of the cabinet 14. However, when the waste bag support mechanism 24 is in its bag removal position the bag support plate 38 is located much closer to the base 22 of the cabinet 14, than the distance B. The importance of this will become clear below.

The waste bag support mechanism 24 operates as follows. With the waste bag support mechanism 24 in the bag removal position, the open end 25*a* of a waste bag 25 is fed upwards through the opening 34 in the compactor plate 32, such that the majority of it hangs down below the compactor plate 32, and its bottom (closed) end reaches or is close to the bag support plate 38. The open end is then spread out around the opening 34, and the handle 42 used to push compactor plate 32 inwards such that the runners 26 are moved from their extended condition to their retracted condition, the handle 42 is then lifted to bring the runners 26 up beneath the shredding mechanism 12 and the waste bag support mechanism 24 into its operating position. A locking means (not shown) is provided to maintain the waste bag support mechanism 24 in that position, which can be of any suitable form. The shredder 10 can then be used and all the shredded material will pass through the opening 34 in the compactor plate 32 and into the waste bag 25.

The bag 25 is retained simply by the proximity of the compactor plate 32 to the underside of the shredding mechanism 12, and the support provided generally by the bag support mechanism 24. However other provision may be made to retain it in position, as appropriate.

The compactor plate 32 operates in known manner to compact the shredded material and to prevent it building up underneath the shredding mechanism 12. That is as the shredding mechanism 12 operates the cutting heads 20 within it push the shredded material out and through the opening 34, the shredded material accumulates in the bag 25 and as it builds up under the compactor plate 32, the plate retains it in the bag 25 and allows more shredded material to be pushed out by the cutting heads 20, through the opening 34 and into the bag 25. Thus as the shredded material builds up in the bag 25 it is compacted. This prevents the shredded material under pressure from pushing back up into the shredding mechanism 12 and jamming it. With the bag support plate 38 beneath the bag 25, such that there is a solid surface both above and below, the bag 25 can hold a very large amount of shredded material and quite a pressure can build up.

When it is desired to change the waste bag 25, the locking means is released and the handle 42 is moved downwards, pivoting the runners 26 about axis A to the maximum angle permitted by the peg 30. This moves the compactor plate 32 downwards away from the shredding mechanism 12, and thus releases the funnel 36 from adjacent the opening in the shredding mechanism 12, and from any accumulation of shredded material which has built up there. This also moves the bag support plate 38 downwards towards the base 22 of the cabinet 14, such that the space beneath the bag support plate 38 is then much less than the distance B. The handle 42 is then pulled outwards to extend the runners 26 and move the compactor plate 32 forwards and out of the cabinet 14, and the waste bag support mechanism 24 into its bag removal position. The compactor plate 32 is then released from the runners 26 and lifted clear. The top end 25*a* of the bag 25 is thus drawn through the opening 34, and pulled upwards, which in general causes any loose shredded material on top of the compactor place 32 to be pulled into the bag 25. The bag 25 can then readily be tied for clean and tidy disposal of the waste shredded material. The bag 25 is then replaced with a new bag 25, as shown in FIG. 2, and the process repeated as required.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A shredder for paper and the like having:

a shredding mechanism with an opening through which shredded material passes out of the shredding mechanism, a compactor plate located beneath the shredding mechanism and including an opening, and a base, wherein the shredder has:

a waste bag support mechanism of which the compactor plate forms a part, and wherein the waste bag support mechanism further includes a waste bag support plate movable between:

an operating position in which the waste bag support plate is located beneath the shedding mechanism above the base of the shredder with a space between the waste bag support plate and the base of the shredder, and a bag removal position in which the waste bag support plate is closer to the base of the shredder.

2. A shredder according to claim 1 wherein the waste bag support mechanism is secured to the underside of the shredding mechanism towards the rear thereof for pivotal movement between:

the operating position in which an upper part of the waste bag support mechanism is close to the underside of the shredding mechanism, and the bag removal position in which the upper part of the waste bag support mechanism is pivoted downwards at its front away from the shredding mechanism.

3. A shredder according to claim 2 wherein the waste bag support mechanism includes extending runners on which the compactor plate is mounted for sliding movement between:

the operating position located beneath the shredding mechanism in which the opening in the compactor plate is substantially directly beneath the opening through which the shredded material passes, and the bag removal position in which the compactor plate is located forward of the shredding mechanism.

4. A shredder according to claim 1 wherein the waste bag support mechanism includes means to retain a waste bag for collection of the shredded material after it has passed through the opening in the compactor plate.

5. A shredder according to claim 4 wherein the compactor plate includes a guide to the opening which, when the waste bag support mechanism is in the operating position is located close to the opening in the shredding mechanism through which the shredded material passes out of the shredding mechanism and wherein the means to retain a waste bag for collection of the shredded material is provided by the proximity of the guide in the compactor plate to the underside of the shredding mechanism.

6. A shredder according to claim 1 wherein the compactor plate includes a guide to the opening which, when the waste bag support mechanism is in the operating position is located close to the opening in the shredding mechanism through which the shredded material passes out of the shredding mechanism.

* * * * *